United States Patent [19]

Kasamura

[11] Patent Number: 4,542,976

[45] Date of Patent: Sep. 24, 1985

[54] PARTIALLY OPENABLE IMAGE FORMING APPARATUS

[75] Inventor: Toshirou Kasamura, Yokohama, Japan

[73] Assignee: Canon Kabushiki Kaisha, Tokyo, Japan

[21] Appl. No.: 488,175

[22] Filed: Apr. 25, 1983

[30] Foreign Application Priority Data

May 6, 1982 [JP] Japan ..... 57-75896

[51] Int. Cl.[4] ..... G03G 15/00

[52] U.S. Cl. ..... 355/3 R; 355/3 DR; 355/3 DD

[58] Field of Search ..... 355/3 R, 3 DR, 3 SH, 355/133, 3 DD, 15; 354/288, 82, 187, 192, 193, 194

[56] References Cited

U.S. PATENT DOCUMENTS

| | | | |
|---|---|---|---|
| 4,241,986 | 12/1980 | Thomson | 354/193 |
| 4,327,992 | 5/1982 | Babicz | 355/3 DR X |
| 4,386,841 | 7/1983 | Wakao et al. | 355/3 DR |
| 4,401,385 | 8/1983 | Katayama et al. | 355/15 |

*Primary Examiner*—A. T. Grimley
*Assistant Examiner*—J. Pendegrass
*Attorney, Agent, or Firm*—Fitzpatrick, Cella, Harper & Scinto

[57] ABSTRACT

In an image forming apparatus having an upper and a lower frame which are discrete from each other, first control means for holding and controlling the upper and lower frames in a partly open position smaller than the fully open position of the upper and lower frames, second control means for holding and controlling the upper and lower frames in the fully open position thereof, and third control means for holding and controlling the upper and lower frames in the fully closed position thereof.

10 Claims, 7 Drawing Figures

PARTIALLY OPENABLE IMAGE FORMING APPARATUS

BACKGROUND OF THE INVENTION

1. Field of the Invention

This invention relates to an image forming apparatus such as an electrophotographic copying apparatus or a recording apparatus. In particular, it relates to an image forming apparatus assuming a construction in which the apparatus body can be divided into upper and lower parts to facilitate the maintenance check-up, cleaning or repair of the apparatus, and further to such an image forming apparatus having a structure which permits a photosensitive medium and some or all of image forming means disposed thereabout to be removably mounted as a unit with respect to the apparatus body (hereinafter referred to as the process kit).

2. Description of the Prior Art

In an image forming apparatus such as, for example, an electrophotographic copying apparatus, it is necessary to carry out interchange of a photosensitive medium as an image bearing member, replenishment of developer, discarding of waste toner, cleaning of the charging wire or maintenance of a developing device, and almost all of these maintenance operations have been carried out by professional servicemen.

However, in a compact electrophotographic copying apparatus directed to personal use and which are increasing in number, the irregularity of the copy volume by the user is great and it becomes difficult for professional servicemen to carry out the maintenance work or the like.

Also, in the conventional copying apparatus, maintenance work has been individually carried out with respect to individual apparatus components (units) which require maintenance or the like. For example, when it has been desired to carry out the maintenance of the photosensitive drum, the members proximate to the photosensitive drum have been temporarily retracted by the use of a retracting mechanism, whereafter the photosensitive drum has been removed from the apparatus to thereby achieve the purpose. At such time, it has sometimes happened that the photosensitive drum is damaged by the proximate members or is stained by the user's hand directly touching the drum, and there has arisen the necessity of placing the photosensitive drum on a table exclusively for use for maintenance after removing it from the apparatus, and then carrying out the maintenance.

Also, as regards the developing device, the surface of the developing roller has sometimes been liable to be damaged or foreign substances have been liable to mix with the developer in the developer storing container. Similarly damage has occured to the charger and the like, and this has often adversely affected the images after the termination of the maintenance and thus, the greatest possible care has been required during the operation of the apparatus.

Further, as regards the cleaner or the like, for example, in a copying apparatus the body of which is divided into upper and lower parts during the treatment of waste toner, the waste toner has scattered within the apparatus or it has been necessary to cover the cleaner with paper or the like in advance so that the scattered toner does not affect the other portion of the apparatus, and furthermore, in a copying apparatus wherein maintenance of the cleaner must be carried out with the cleaner removed from the apparatus body, a table exclusively for use for maintenance has been required.

In this connection, a copying apparatus construction has been proposed in which, for example, some or all of the photosensitive drum, the charger, the developing device, the cleaner unit, etc. are integrally made into a process kit which may be removably assembled to the copying apparatus body to thereby facilitate the maintenance.

That is, by adopting a construction in which the photosensitive and some or all of the image forming means disposed thereabout, for example, the charger, the developing device and the cleaner, are integrally made into a kit (unit within the unit) which may be mounted on a frame member removably mounted with respect to the apparatus body, the removal of the interior of the apparatus and accordingly the maintenance thereof becomes easy. In other words, if a construction is adopted in which the frame member including said kit is held, for example, in a sufficiently forwardly projected condition with respect to the apparatus body and if a construction is adopted in which the kit is readily removably mounted with respect to the frame member, the number of proximate members which may interfere with their neighborhood will be decreased and the degree of freedom in all directions will be increased and the special table exclusively for use for maintenance will become unnecessary and thus, there will be provided an apparatus which is free of the evils peculiar to the conventional apparatus and is better in operability.

On the other hand, there are some copying apparatuses the body of which is divided into upper and lower parts to enable the interior of the apparatus to be opened to facilitate the works such as maintenance check-up, cleaning and repair of the copying apparatus. In such apparatuses, the upper frame provided with an exposure mechanism, a charger, a photosensitive medium, a developing device, a cleaner, etc. is pivotally connected to the lower frame with one end of the upper frame as the fulcrum. When maintenance check-up or repair of the interior of the apparatus body is required, the upper frame may be widely opened upwardly with respect to the lower frame to open the interior of the apparatus, whereafter the necessary work may be carried out.

With the recent increasing tendency of the copying apparatus toward compactness, light weight and personal use, such apparatus construction is becoming widely adopted as being very effective to carry out maintenance and particularly, when the work resulting from the occurrence of paper jam within the copying apparatus or other maintenance check-up or repair is to be carried out, the upper frame may be inclined greatly, say, by about 20°, with respect to the lower frame (horizontal) to provide very good operability.

Now, as a specific means for making the process kit removably mountable to facilitate the maintenance, it would occur to mind to temporarily retract the members proximate to the process kit, such as the charger, the separating member, the guide member, the conveying member, etc. when required or to open the upper and lower frames by a certain necessary amount.

However, it is not preferable to combine the former means with the opening-closing mechanism for the upper and lower frames for copying with the work resulting from the occurrence of paper jam or other maintenance check-up or repair, and cumbersomeness results from the use of the former means itself with attendant increased cost. That is, when a member proximate to the process kit, for example, the charger, is temporarily retracted, there will arise problems regarding the connection between the charger and the high voltage input contact, the cord treatment or the mounting-dismounting of the charger itself, and the insurance of the position of the charger.

Also, in the case of the separating member, there will arise problems regarding the method of separate driving, the reproducibility of positional accuracy, the treatment of a separating belt if it is adopted, and the method of stretching the belt.

Similar problems will occur to the guide member and the conveying member. Temporarily retracting such members proximate to the process kit will complicate the retracting mechanism itself as the apparatus becomes more compact.

Furthermore, the aforementioned units must unavoidably be arranged more proximately to one another as the apparatus becomes more compact and in this point as well, the former means may be said to be practically difficult.

In contrast, the latter means can achieve the purpose relatively easily by a simple mechanism and in the same way as the method of copying with the occurrence of paper jam. Thus, the maintenance can be carried out relatively easily in a copying apparatus the body of which is divided into upper and lower parts and which permits the process kit to be removably mounted with respect to the apparatus body.

However, when the upper frame is opened for maintenance or the like, the upper frame is greatly inclined with respect to the lower frame (horizontal) and accordingly, the process kit installed within the upper frame is also greatly inclined with respect to the lower frame. If the process kit is separated with respect to the apparatus body with the upper frame thus greatly inclined with respect to the lower frame, toner may spill out of the waste toner container during discarding of the waste toner in the cleaner because the cleaner is greatly inclined, or it may be impossible to fully replenish the developer container with fresh developer because the container is greatly inclined when the developing device is to be supplied with developer, and further, the great inclination of the upper frame may make the operability very poor when said operation is performed.

In this manner, carrying out the maintenance with the upper frame or the process kit greatly inclined with respect to the lower frame leads to poor operability and reduced function of the copying apparatus, and improvements in this respect are desired.

SUMMARY OF THE INVENTION

In view of the above-noted problems peculiar to the prior art, the present invention intends to provide an image forming apparatus of a construction which can be divided into upper and lower parts and which has a process kit which permits a photosensitive medium and some or all of image forming means disposed thereabout to be removably mounted as a unit with respect to the apparatus body and wherein no hindrance in operation is caused both during maintenance or repair resulting from paper jam or the like and during maintenance of the process kit such as interchange of the photosensitive medium, replenishment of developer, discarding of waste toner or cleaning of charging wire.

More specifically, the present invention intends to provide such an image forming apparatus in which the open position of upper and lower frames is controlled to at least two stages. That is, the present invention intends to provide an image forming apparatus which permits mounting-dismounting maintenance of the process kit or other maintenance check-up or repair to be carried out at least at the first stage of the open position of the upper and lower frames, or in the so-called half-locked condition wherein the upper and lower frames are slightly opened and permits maintenance check-up or repair resulting from paper jam or the like to be carried out at least at the second and subsequent stages of the open position.

The invention will become fully apparent from the following detailed description thereof taken in conjunction with the accompanying drawings.

DESCRIPTION OF THE PREFERRED EMBODIMENTS

Figure 1:
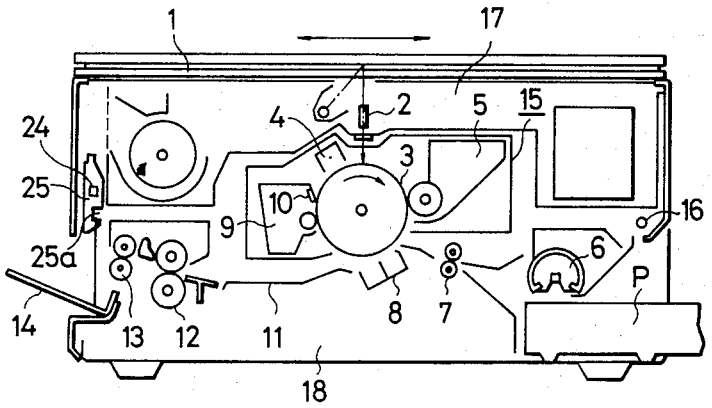
FIG. 1 is a longitudinal cross-sectional view of an image forming apparatus according to the present invention in its fully closed postion.

Referring to FIG. 1 which is a cross-sectional view of an image forming apparatus to which the present invention is directed, reference numeral 1 designates an original carriage formed of a transparent material and reciprocally movable in the direction of double-headed arrow. Denoted by 2 is a small-diameter imaging element array. The image of an original placed on the original carriage 1 is slit-projected onto a rotatable photosensitive drum 3. Designated by 4 is a charger for uniformly charging the photosensitive drum 3. The charged drum 3 is exposed to the image light by the imaging element array 2, whereby an electrostatic image is formed on the surface of the drum 3. The electrostatic image is developed into a visible image by a developing device 5. On the other hand, transfer paper P is fed in between the drum 3 and a transfer charger 8 by a paper feed roller 6 and register rollers 7 rotated with such a timing as to register with the image on the photosensitive drum 3, and the toner image on the photosensitive drum 3 is transferred onto the transfer paper P by the transfer charger 8. The transfer paper P having had the image transferred thereto is then separated from the drum 3 and is directed by a guide 11 to a fixing device 12 where the image on the transfer paper is fixed, whereafter the transfer paper is discharged as a copy onto a tray 14 by discharge rollers 13. On the other hand, after having passed the transfer station, the surface of the photosensitive drum 3 is cleaned by the rubber blade 10 of a cleaning device 9 so that any toner remaining thereon is removed, thus becoming ready for another cycle of copying.

Designated by 15 is the housing of a process kit. The photosensitive drum 3, the charger 4, the developing device 5 and the cleaner 9 together constitute the process kit, and the housing 15 can be drawn out of the apparatus body.

Figure 2:
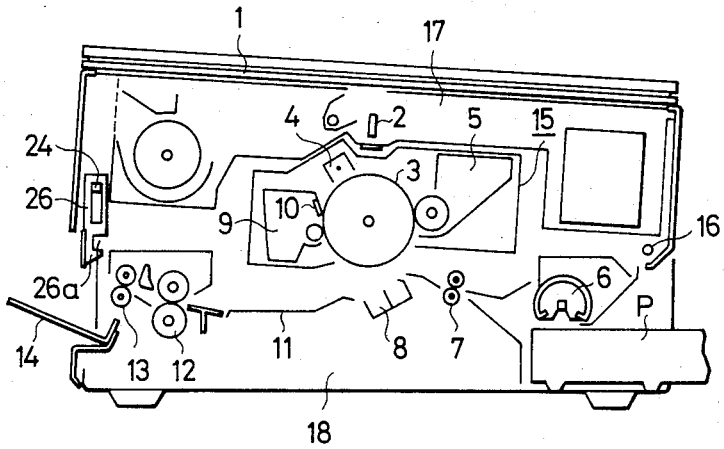
FIG. 2 is a longitudinal cross-sectional view of the image forming apparatus in its half-locked position (a first open position).
Figure 3:
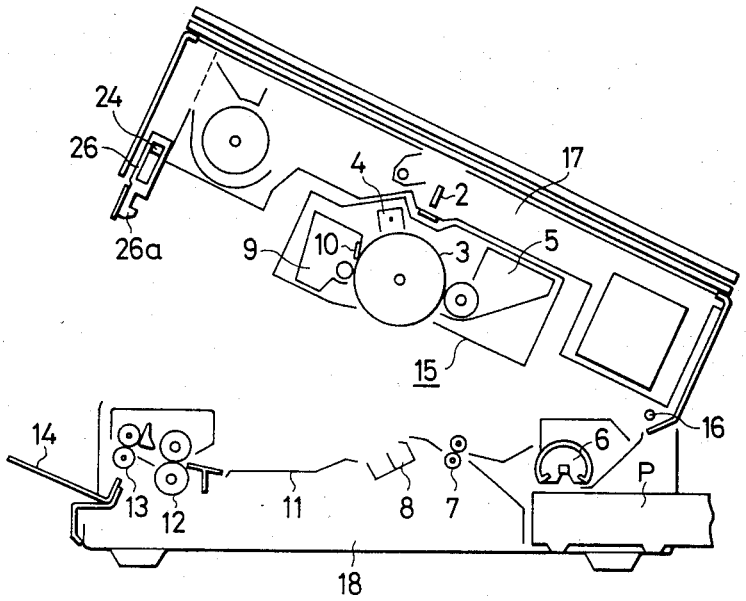
FIG 3. is a longitudinal cross-sectional view of the image forming apparatus in its fully open position (a second open position).

FIGS. 2 and 3 show the body of the image forming apparatus to which the present invention is directed as opened and separated into an upper frame 17 and a lower frame 18 by two-stage opening means with a shaft 16 as the pivot axis. The opened position of the upper frame is controlled to two stages, i.e., a first open position (FIG. 2, half-locked position) and a second open position (FIG. 3, fully open position).

Figure 4:
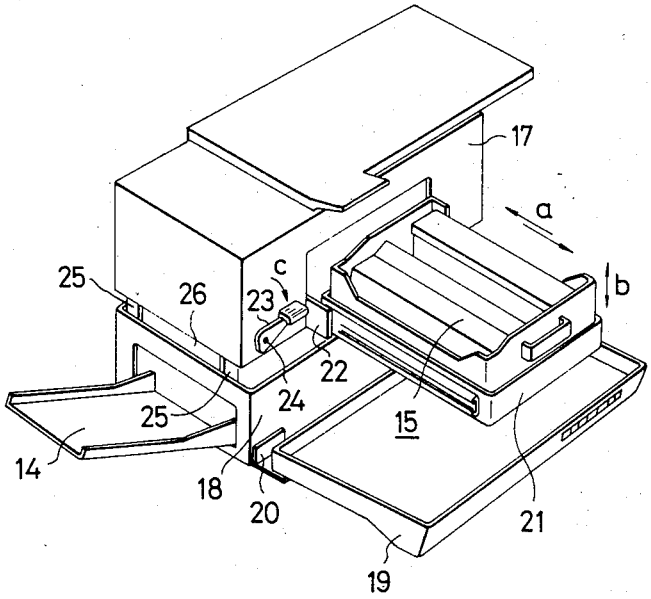
FIG. 4 is a perspective view showing a process kit housing as drawn out of the apparatus in the half-locked position.

FIG. 4 shows a perspective view in which the process kit has been retracted outwardly of the apparatus body in the first open position (FIG. 2) of the image forming apparatus to which the present invention is directed. In FIG. 4, reference numeral 19 designates the front door of the apparatus body. As shown, the front door 19 may be opened and closed with a front door support plate 20 as the hinge, the front door support plate 20 being installed at a portion of the lower frame 18. On the upper frame 17, a pair of rail members 22 are installed for movement in the direction of arrow a. (axial direction of the apparatus) by well-known connecting means. A process kit holding frame 21 is secured to the rail members 22 by fastener members such as screws or the like (not shown), and the process kit 15 is held in the process kit holding frame 21. The process kit 15 is held removably in the direction of arrow b relative to the process kit holding frame 21. Designated by 23 is a lever installed in the upper frame 17.

Figure 5:
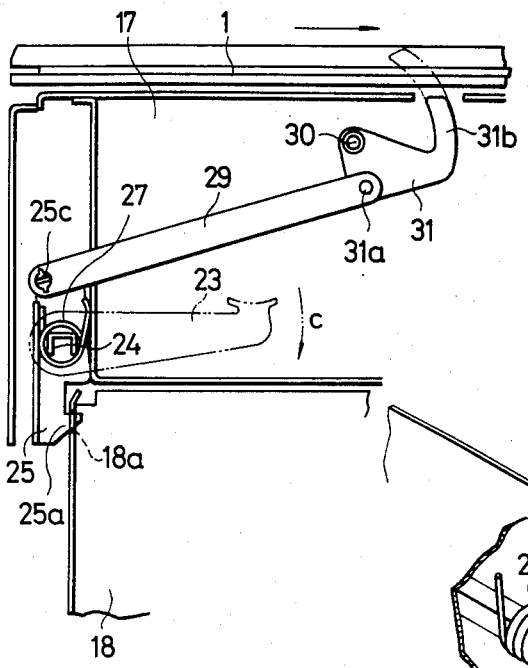
FIG. 5 is a longitudinal cross-sectional view of a first locking portion.
Figure 6:
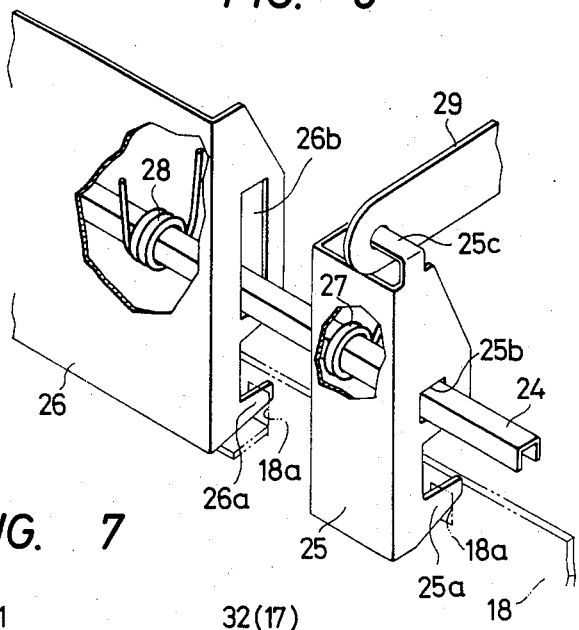
FIG. 6 is a perspective view of first and second locking portions.

FIGS. 5 and 6 show an example of the means for controlling the opened position of the copying apparatus to which the present invention is directed. Reference numeral 24 designates a locking shaft rotatably installed in the upper frame 17 by a bearing member, not shown. On this locking shaft 24, a first lock 25 is integrally installed so as to move with rotation of the locking shaft 24 and a second lock 26 is installed independently of rotation of the locking shaft 24 and pivotably. The locking shaft 24 assumes a square shape having a U-shaped cross-section, and the connection thereof with the first lock 25 is supported by the square cross-sectional shape **25*b* of the latter and the connection thereof with the second lock 26 is supported by a rectangular slot 26*b* having two sides larger than the locking shaft 24**.

Within the first lock 25 and the second lock 26, springs 27 and 28 for normally biasing these locks, respectively, in one direction (counterclockwise direction as viewed in FIG. 6) about the shaft 24 are installed on the locking shaft 24.

A connecting plate 29 having one end engaged with one end **25*c* of the first lock 25 is installed on the first lock 25 in accordance with the technique disclosed in Japanese Patent Application No. 60794/1979, and the other end of the connecting plate 29 is connected to one end 31*a* of a stop lever 31 pivotable about a center shaft 30 installed in the upper frame 17**.

A lever 23 (dots-and-dash line in FIGS. 4 and 5) is secured to one end of the locking shaft 24 by fastener means (not shown) such as a screw or the like.

In the specific embodiment of the present invention, both the first lock 25 and second lock 26 are installed on the forward and rearward portions of the shaft 24 so as to ensure reliable connection between the upper frame 17 and the lower frame 18.

In the fully closed position (FIG. 1) of the upper and lower frames 17 and 18, the hook **25*a* of the first lock 25 is in engagement with an engagement hole 18*a* (see FIG. 6; it may also be an engagement cross bar or hook) formed in the lower frame 18 and the upper frame 17 is kept in its closed condition relative to the lower frame 18 against the self-opening force about the shaft 16 which is moderately imparted to the upper frame 17 in advance. In this case, the first lock 25 is biased by the spring 27 for rotation about the shaft 24 in a direction in which the hook 25 is engaged with the hole 18*a* and therefore, unless any artificial extraneous force is exerted, the engagement of the hook 25*a* with the hole 18*a* is kept firmly and the closed position of the upper and lower frames 17 and 18** is never naturally released.

The hook **26*a* of the second lock 26 is also in engagement with the corresponding engagement hole 18*a* in the lower frame 18, but this lock 26 does not perform a locking function for keeping the upper and lower frames 17 and 18 in their fully closed position since it is mounted on the locking shaft 24 through the slot 26*b***.

To obtain the first open position (FIG. 2) during the maintenance of the process kit as previously described, i.e., during the maintenance check-up such as interchange of the photosensitive medium, replenishment of developer, discarding of waste toner or cleaning of charging wire, the original carriage 1 is first moved to the right as indicated by arrow in FIG. 5, and then the front door 19 (FIG. 4) is brought down forwardly into its open position about the hinge 20, whereafter the lever 23 is pivoted clockwisely about the shaft 24 as indicated by arrow c.

Upon this release of the first lock 25, the upper frame 17 opens and upwardly moves from the lower frame 18 about the shaft 16 due to its self-opening force, but in the course of such movement, the locking shaft 24 strikes against the upper end of the slot **26*b* in the second lock 26 and the hook 26*a* at the lower end of the lock 26 keeps its engagement with the hole 18*a* in the lower frame 18 and therefore, at that point of time, the opening movement of the upper frame 17 is stopped and the angle of opening thereof is maintained. This is the first open position of FIGS. 2 and 4, and the angle of opening can be suitably selected by suitably selecting the length of the slot 26*b* in the second lock 26**.

Even if an attempt is made to move the lever 23 clockwisely without moving the original carriage glass 1, one end **31*b* of the stop lever 31 operated by the connecting plate 29 engaged with one end 25*c* of the first lock 25 interferes with the glass 1 and the lever 23 cannot be moved and thus, the upper frame 17 cannot be opened any more with respect to the lower frame 18**.

This first open position permits the process kit in the upper frame 17 to be drawn out toward the front side of the upper frame 17 through the rail members 22 and the holding frame 21, as shown in FIG. 4, and by drawing out the process kit or further lifting and removing the process kit from the holding frame 21, the work such as maintenance check-up or repair can be carried out easily and without imparting impediments to other members.

When it is desired to bring the upper frame 17 into the second open position (FIG. 3) in which the upper frame is further open with respect to the lower frame 18 for the purpose of eliminating paper jam or for other purpose, the upper frame 17 is temporarily brought into the first open position (FIG. 2) in the above-described procedure, whereafter a hand is inserted through the opening thereof to rotate the second lock 26 against the force of the spring 28 by means of a second lever (not shown) provided at a portion of the second lock 26. Thereupon, the hook 26*a* of the second lock 26 becomes disengaged from the hole 18*a* in the lower frame 18 and the half-locked condition of the upper frame 17 is released to permit the upper frame 17 to further open and pivot about the shaft 16 to a certain degree due to its self-opening force. The thus liberated upper frame 17 is then manually opened at any desired large angle of opening and desired work may be carried out with that open state of the upper frame being maintained by a stay or other suitable restraining means (not shown).

In FIGS. 5 and 6 which show a specific embodiment of the present invention, the procedure of bringing the upper frame 17 into the second open position comprises liberating the first lock 25 and then liberating the second lock 26. That is, the second lock 26 cannot be touched unless the first lock 25 is liberated and thereby the upper frame 17 is opened to a certain degree with respect to the lower frame 18. Accordingly, even if the second lock 26 is manually liberated earlier than the first lock 25 for some reason or other, the upper frame 17 cannot be opened with respect to the lower frame 18 because the first lock 25 is engaged.

The operation of bringing the upper frame from the first open position (FIG. 4) back to the fully closed position (FIG. 1) may be achieved by properly setting the process kit housing 15 on the holding frame 21 after maintenance check-up or repair, fully pushing the holding frame 21 into a regular pushed-in position in the upper frame 17, and then depressing the upper frame 17 in the closing direction about the shaft 16 relative to the lower frame 18 against the self-opening force of the upper frame. Thereupon, the hook 25*a* of the first lock 25 again becomes automatically engaged with the engagement hole 18*a* in the lower frame 18. Alternatively, the lever 23 may be depressed clockwisely against the force of the spring 27, whereby the upper frame 17 may be fully depressed with the hook 25*a* of the first lock 25 being brought into an escape position in which it does not interfere with the upper edge of the lower frame 18 (or the upper edge of a cross bar engaged by the hook or of the hook), whereafter the lever 23 may be released and by the backward rotation of this lever 23, the hook 25*a* may be brought into the hole 18*a* and thus, the upper frame 17 may be locked in the fully closed position with respect to the lower frame 18. Thereafter, the front door 19 may be closed and the carriage glass 1 may be returned to the left.

To bring the upper frame 17 from the second open position (FIG. 3) back to the fully closed position (FIG. 1), the stay or the like holding the upper frame 17 in its fully open condition may be removed and the upper frame 17 may be depressed relative to the lower frame 18 against the self-opening force of the upper frame, whereupon first the hook 26*a* of the second lock 26 and then the hook 25*a* of the first lock 25 become automatically engaged with the corresponding engagement holes 18*a* and 18*a*, respectively, in the lower frame 18, whereby the upper frame is held in its fully closed position. Alternatively, the upper frame 17 may be depressed and by operating a lever attached to the second lock 26, the hook 26*a* of the second lock 26 may be brought into engagement with the hole 18*a*, and then the upper frame 17 may be further depressed and by operating the lever 23, the hook 25*a* of the first lock 25 may be brought into engagement with the hole 18*a*. Thereby, the upper frame 17 may be held in its fully closed position with respect to the lower frame 18.

As described above, according to the present invention, during the maintenance work of the process kit, the apparatus is brought into the first open position or the so-called half-locked position and, during the elimination of paper jam or the like, the apparatus is brought into the second open position or the so-called fully open position, whereby the operability of the copying apparatus can be readily enhanced without marring the function of the apparatus.

The present invention not only controls the opened position shown in the above-described specific embodiment to two stages, but also of course includes controlling the opened position to more than two stages.

In the present invention, the angle of full opening of the apparatus is not limited to the maximum angle of opening of 20° shown above, but may be selected as desired.

Figure 7:
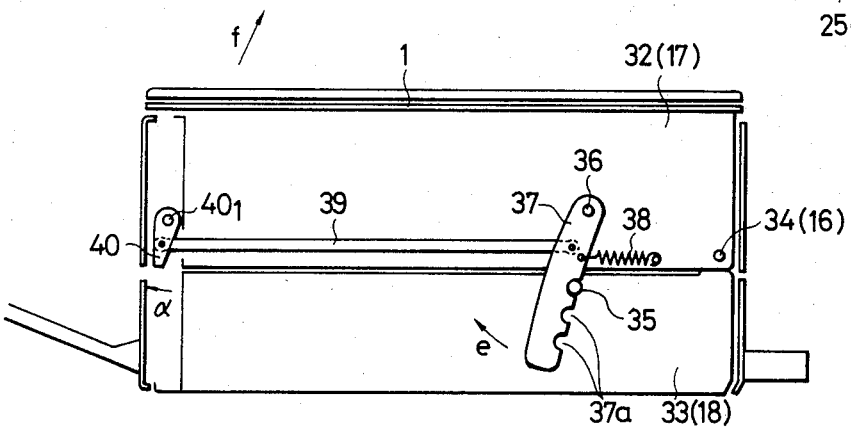
FIG. 7 is a longitudinal cross-sectional view showing another embodiment of the locking mechanism.

Referring now to FIG. 7 which shows another embodiment of the present invention, reference numeral 32 designates an upper frame and reference numeral 33 denotes a lower frame. The upper frame 32 is openable and closable with a central shaft 34 as the axis of pivotal movement, the central shaft 34 being provided at a portion of the lower frame 33. Designated by 37 is a connecting lever connecting the upper frame 32 and the lower frame 33. One end of the connecting lever 37 is pivotably installed on the fixed shaft 36 of the upper frame 32, while a plurality of grooves 37*a* formed in the other end portion of the connecting lever 37 are engageable by a connecting pin 35 secured to the lower frame 33. Denoted by 38 is a connecting lever biasing spring for normally biasing the connecting lever 37 for rotation in a counterclockwise direction in which the grooves 37*a* are engaged by the pin 37.

A lever 40 is pivotably installed on the upper frame 32 by a well-known installing means, and a connecting plate 39 extends from the lever 40 to the connecting lever 37. The control of the opened position of the upper and lower frames 32 and 33 is determined by the position of the groove of the connecting lever 37 engaged by the connecting pin 35.

In the above-described construction, when the lever 40 is rotated clockwisely about a shaft $40_1$ as indicated by arrow d, the connecting lever 37 pivots clockwisely about the shaft 36 as indicated by arrow e against the force of the spring 38. Therefore, the engagement between a groove 37*a* of the connecting lever 37 and the connecting pin 35 is released to permit the upper frame 32 to open in the direction of arrow f with the central shaft 34 as axis of pivotal movement, with respect to the lower frame 33.

By bringing the connecting pin 35 into engagement with any groove 37*a* of the connecting lever 37, any desired angle of opening of the upper and lower frames can be obtained.

In the present embodiment, three uppermost, middle and lowermost grooves 37*a* are provided in the lever 37. When the uppermost groove is engaged by the pin 35, the fully closed position of the upper frame 32 with respect to the lower frame 33 is maintained; when the middle groove is engaged by the pin 35, the half-locked position is obtained; and when the lowermost groove is engaged by the pin 35, the fully open position is obtained.

The present invention has been described with respect to its effect when used with a copying apparatus adopting a process kit, but the invention is also applicable to ordinally image forming apparatuses for the following reason.

The popular image forming apparatus assuming a construction which can be divided into upper and lower parts only requires a great angle of opening during the maintenance check-up resulting from paper jam or the like, and now that unitization is advancing in recent years, so great an angle of opening is not required when the so-called unit is mounted or dismounted during the other maintenance works, but it is only required that members proximate to the unit which requires maintenance be spaced apart by a predetermined amount from the location which has an effect on the mounting or dismounting. On the other hand, in the image forming apparatus which have been put into practical use in recent years or which will be put into practical use in the future, it is expected that the rate of occurrence of paper jam will be greatly reduced and a great angle of opening will be required less often and accordingly it will become unnecessary to always provide a great angle of opening. Also, in the maintenance of the units disposed at the end portion of the copying apparatus as shown in FIG. 1 such as the fixing station or the paper discharge station, a great angle of opening is not required. Further, it is not preferable from the viewpoint of operability or function to provide the upper and lower frames of the apparatus with a great angle of opening and accordingly, in this point as well, the original object can be achieved more easily by using the present invention.

Therefore, of course, the present invention is applicable not only to image forming apparatuses containing therein the process kit shown above in the specific embodiments, but also to ordinary image forming apparatuses.

What I claim is:

1. An image forming apparatus having:

an upper and a lower structure which are discrete from each other;

an image formation process kit removably held by said upper structure;

first control means for holding and controlling said upper and lower structures in a partly open position smaller than the fully open position of said upper and lower structures to render said image formation process kit removably mountable in said partly open position;

second control means for holding and controlling said upper and lower structures in the fully open position thereof to enable paper jam or the like to be dealt with; and third control means for holding and controlling said upper and lower structures in the fully closed position thereof.

2. An image forming apparatus according to claim 1, wherein said process kit includes an image bearing member and a container for containing developer.

3. An image forming apparatus according to claim 2, wherein said developer container is included in a cleaning device for removing developer from said image bearing member.

4. An image forming apparatus according to claim 2, wherein said developer container is included in a developing device.

5. An image forming apparatus according to claim 4, wherein said process kit further includes a cleaning device for removing developer from said image bearing member.

6. An image forming apparatus comprising:

an apparatus body having a first housing and a second housing openable so as to be inclined with respect to said first housing;

a process kit removably mounted to said second housing, said process kit including an image bearing member, a container to contain a developer, and supporting means to support said image bearing member and said container; and means for holding said first and second housings in an open state at an angle smaller than the fully opened angle therebetween to permit maintenance.

7. An image forming apparatus according to claim 6, wherein said developer container is a developing device and wherein said process kit further includes a cleaning device for removing developer from said image bearing member.

8. An image forming apparatus comprising:

a first housing;

a second housing openable so as to be inclined to said first housing and removably holding an image bearing member and a container for containing a developer; and means for holding said first and second housings in an open state at an angle smaller than the fully opened angle therebetween to permit maintenance.

9. An image forming apparatus according to claim 6 or 8, wherein said developer container is a developing device.

10. An image forming apparatus according to claim 6 or 8, wherein said developer container is a cleaning device for removing developer from said image bearing member.

* * * * *